US006062927A

United States Patent [19]

Hiraoka et al.

[11] Patent Number: 6,062,927

[45] Date of Patent: May 16, 2000

[54] COMPONENT ARRANGEMENT FOR OUTBOARD MOTOR

[75] Inventors: Noriyoshi Hiraoka; Masanori Takahashi, both of Hamamatsu, Japan

[73] Assignee: Sanshin Kogyo Kabushiki Kaisha, Hamamatsu, Japan

[21] Appl. No.: 09/018,901

[22] Filed: Feb. 5, 1998

[30] Foreign Application Priority Data

Feb. 5, 1997 [JP] Japan ..... 9-022413

[51] Int. Cl.[7] ..... B63H 21/38

[52] U.S. Cl. ..... 440/88; 123/184.34; 123/184.47

[58] Field of Search ..... 440/88; 123/184.31, 123/184.34, 184.47

[56] References Cited

U.S. PATENT DOCUMENTS

| | | | |
|---|---|---|---|
| 4,827,722 | 5/1989 | Torigai . | |
| 4,967,704 | 11/1990 | Imaeda . | |
| 5,476,402 | 12/1995 | Nakai et al. . | |
| 5,488,939 | 2/1996 | Nakai et al. . | |
| 5,505,166 | 4/1996 | Katoh . | |
| 5,513,606 | 5/1996 | Shibata . | |
| 5,549,091 | 8/1996 | Tsunoda et al. | 123/476 |
| 5,553,586 | 9/1996 | Koishikawa et al. | 123/195 P |
| 5,683,277 | 11/1997 | Tsunoda et al. | 440/88 |
| 5,713,772 | 2/1998 | Takahashi et al. . | |
| 5,743,228 | 4/1998 | Takahashi . | |
| 5,752,866 | 5/1998 | Takahashi et al. | 440/88 |
| 5,865,655 | 2/1999 | Hiraoka et al. | 440/89 |
| 5,873,332 | 2/1999 | taue et al. | 123/52.4 |

*Primary Examiner*—Sherman Basinger
*Attorney, Agent, or Firm*—Knobbe, Martens, Olson & Bear LLP

[57] ABSTRACT

This invention is an outboard motor for use in propelling a watercraft. The motor has a cowling in which is positioned an internal combustion engine. The internal combustion engine comprises a V shaped cylinder block cooperating with first and second cylinder heads to define first and second cylinder banks. The cylinder banks form a valley therebetween. Each of the cylinder banks include at least one combustion chamber. A crankcase is located at an end of the block opposite the heads forming a crankcase chamber. The engine also includes an exhaust system for routing the products of combustion from at least one combustion chamber and an intake system for providing air to the at least one combustion chamber. The intake system includes a single surge tank positioned between the cowling and the crankcase of the engine. At least one first intake pipe extends from the surge tank in a first direction along the cylinder block to the first cylinder head and at least one second intake pipe extends along the cylinder block to the second cylinder head.

10 Claims, 5 Drawing Sheets

COMPONENT ARRANGEMENT FOR OUTBOARD MOTOR

FIELD OF THE INVENTION

The present invention relates to an engine of the type utilized to power an outboard motor. More particularly, the invention comprises an induction and component arrangement for such an engine.

BACKGROUND OF THE INVENTION

It is well known that internal combustion engines have been used to power watercrafts. Ever since the first motor was placed on a watercraft, the market place demanded more performance from the watercraft in terms of more output from the engine or better fuel economy or a combination of these as well as other factors. To achieve increased performance, larger engines, with more output, were mounted to watercraft. By merely changing one variable, such as engine output, other variables may be compromised. For instance, increasing the output of the motor typically requires a physically larger motor, which compromises other design variables. Not only is a large engine aesthetically unappealing, but gives rise to detriments such as overall watercraft packaging concerns and aerodynamic effects which decrease performance.

It is therefore, an objective of this invention, to create a mounting arrangement for an outboard watercraft that is compact in order for easy packaging on an associated watercraft.

As is mentioned above, it is common for a larger output engine to occupy a greater amount of space than a smaller engine. Typically the internal combustion engines for outboard motors are covered, at least in part, by a protective cowling to protect them from the elements and to provide a somewhat aerodynamic cover of the engine. A larger engine, regardless of whether it is covered with a protective cowling, will have a greater aerodynamic drag than a smaller engine. A larger engine will therefore typically create a larger amount of drag thereby decreasing the performance and the fuel economy of the internal combustion engine.

It is therefore an objective of this invention to create a mounting arrangement for an outboard watercraft that is compact in order to improve the overall engine performance and increase fuel economy.

Internal combustion engines typically have air induction systems which provide air to the engine. These induction systems typically include a plurality of intake pipes for delivery the air from an intake portion to the combustion chamber. Typically these intake pipes are connected to a plurality of surge tanks which provide a buffer of air that helps promote a uniform charge of air is delivered to each combustion chamber of the engine. In some engines, because of the design of the surge tank, the intake pipes, and the order of firing of the different cylinders, the combustion chambers may be starved of air and not receive a fall charge and therefore not achieve the desired performance or fuel consumption efficiency.

It is well known that changing the arrangement of the intake pipes alters the performance of the internal combustion engine. In particular, for certain engines, by lengthening the intake pipes and changing the location of surge tanks, the performance at lower speeds may be enhanced. Lengthening the pipes, however, typically increases the volume occupied by the engine, thereby increasing the overall size of the engine.

It is therefore an object of the invention to provide a compact arrangement of the components of the internal combustion engine which allows a design with increased length intake pipes.

SUMMARY OF THE INVENTION

In accordance with the present invention, there is provided an outboard motor for use in propelling a watercraft. The motor has a cowling in which is positioned an internal combustion engine. The internal combustion engine comprises a V shaped cylinder block cooperating with first and second cylinder heads to define first and second cylinder banks. The cylinder banks form a valley therebetween. Each of the cylinder banks includes at least one combustion chamber. A crankcase is located at an end of the block opposite to the heads forming a crankcase chamber. The engine also includes an exhaust system for routing the products of combustion from the at least one combustion chamber and an intake system for providing air to the at least one combustion chamber. The intake system includes a single surge tank positioned between the cowling and the crankcase of the engine. At least one first intake pipe extends from the surge tank in a first direction along the cylinder block to the first cylinder head and at least one second intake pipe extends along the cylinder block to the second cylinder head.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

This invention provides an outboard motor powered by an engine with an improved induction system and component arrangement. The engine, as described, is designed for use with an outboard motor because in this application a compact arrangement is of particular utility. It should be understood, however, that an engine including this arrangement may be used in other applications.

Figure 1:
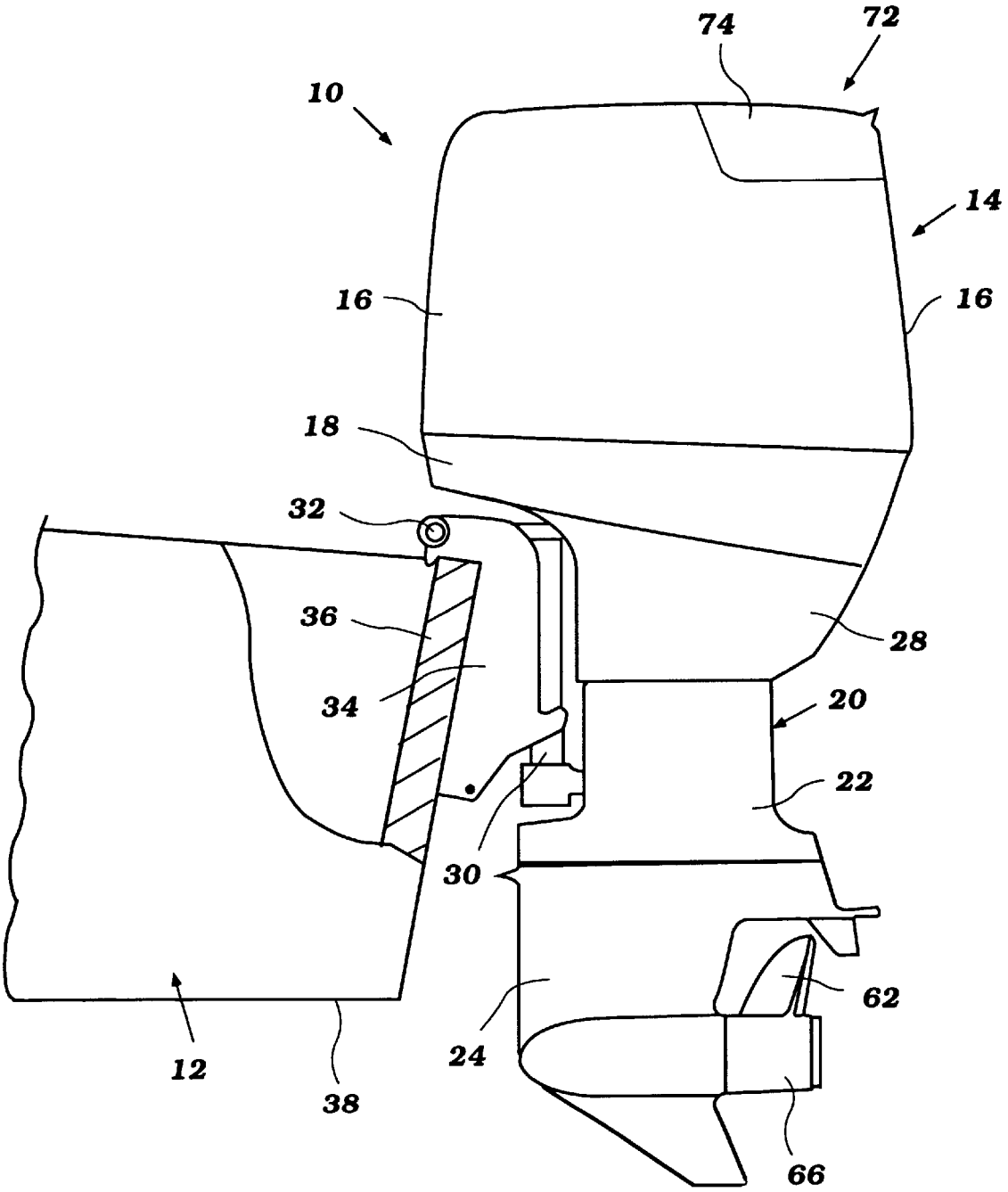
FIG. 1 is a side view of an outboard motor connected to a hull, illustrated partially in cross-section, of a watercraft.

As illustrated in FIG. 1, the outboard motor 10, is of the type utilize to propel a watercraft 12. The outboard motor 10 has a powerhead area 14 comprised of upper and lower cowling portions 16, 18. The motor 10 includes a lower unit 20 extending downwardly from the cowling portion 18. The lower unit 20 comprises an upper or "drive shaft housing" section 22 and a lower section 24. An apron 28 is positioned between the powerhead 14 and lower unit 20.

The powerhead area 14 of the motor 10 is connected to a steering shaft (not shown). The steering shaft is supported for steering movement about a vertically extending axis within a swivel or steering bracket 30, permitting movement of the motor 10 to the left and right for steering the watercraft 12 to which it is attached.

The swivel bracket 30 is connected by means of a pivot pin 32 to a clamping bracket 34 which is attached to a transom portion 36 of a hull 38 of the watercraft 12. The pivot pin 32 permits the outboard motor 10 to be trimmed and tilted up about the horizontally disposed axis formed by the pivot pin 32.

Figure 2:
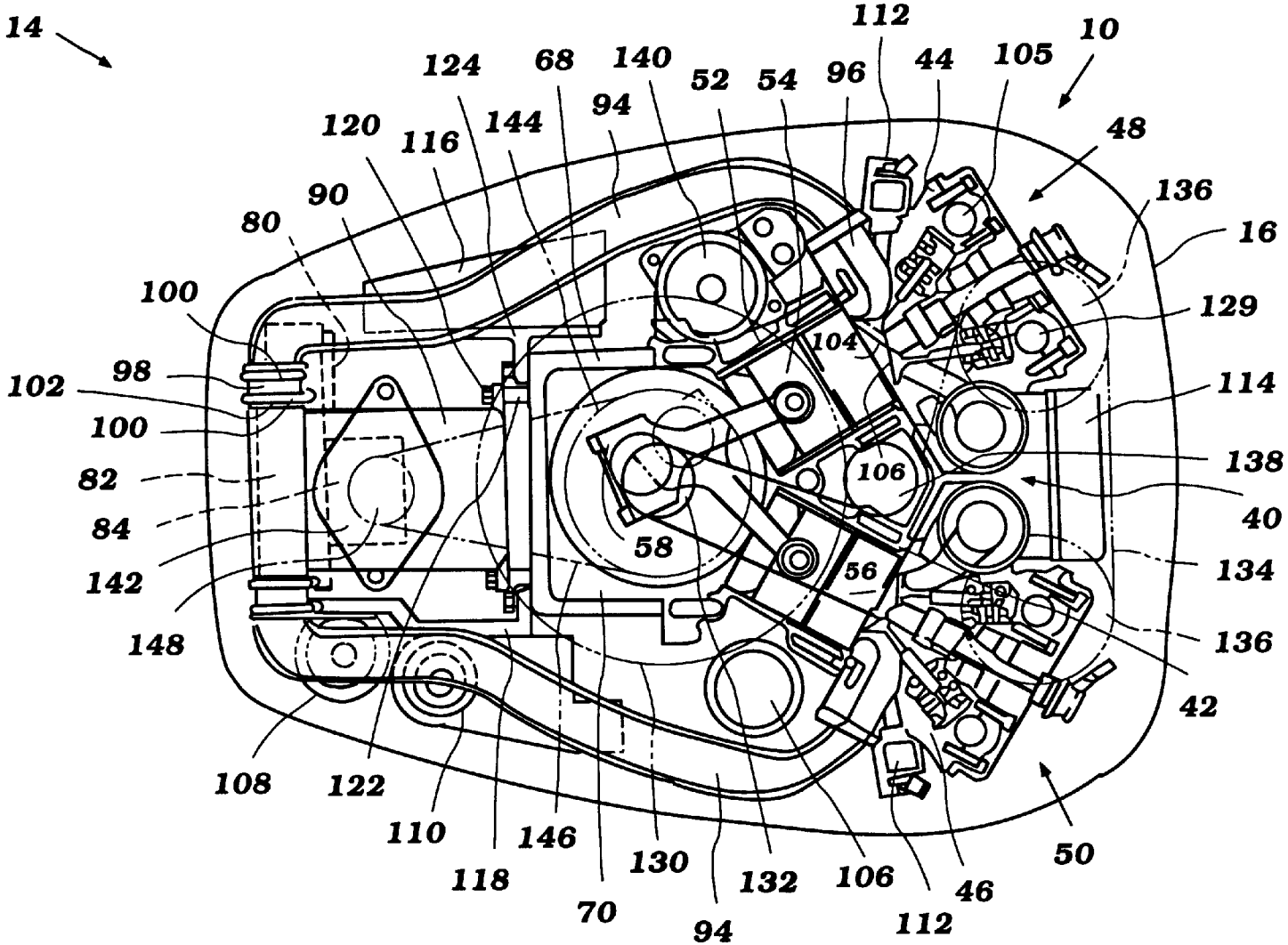
FIG. 2 is a top cross-sectional view of the motor and engine therein, the engine having an induction and component arrangement in accordance with the present invention.

Referring to FIG. 2, the power head 14 of the outboard motor 10 includes the engine 40 which is positioned within the cowling portion 16. The engine 40 is preferably of the six-cylinder variety arranged in a "V" fashion. Preferably, the engine 40 operates on a four-cycle principle. Those of skill in the art will appreciate that the engine 40 may have a greater or lesser number of cylinders, be arranged in other than "V" fashion, and operate in accordance with other principles, such as two-cycle or rotary principles.

In this arrangement, the engine 40 has a cylinder block 42 with a first cylinder head 44 and a second cylinder head 46 connected thereto and cooperating therewith to define first and second cylinder banks 48, 50 defining a valley therebetween. This valley faces away from the watercraft to which the motor 10 is attached.

The cylinder block 42 defines three cylinders 52 in each bank. As described in more detail below, a piston 54 is movably positioned in each cylinder 52. A combustion chamber 56 is defined by the top of each piston 54, a respective cylinder head 44, 46 and the wall of the block 42 defining each cylinder 52.

Each piston 54 is connected to a connecting rod 58 extending to a vertically extending crankshaft 60. The crankshaft 60 is arranged to drive a water propulsion device associated with the motor 20. Preferably, this water propulsion device comprises a propeller 62 (see FIG. 1).

Figure 3:
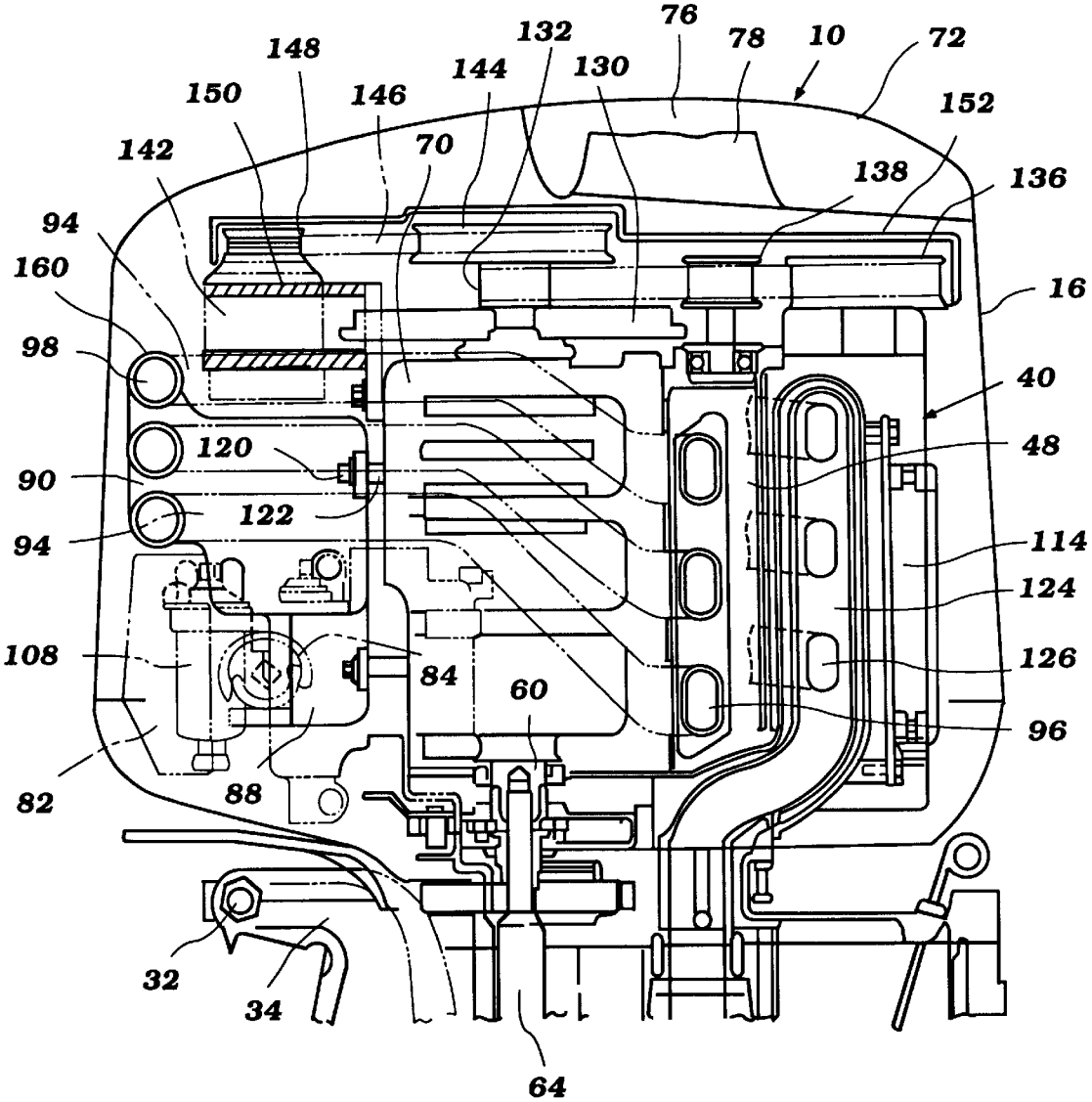
FIG. 3 is a cross-sectional side view of a first side of a powerhead portion of the motor illustrated in FIG. 1, with portions of the engine also illustrated in cross-section.

Referring to FIG. 3, the crankshaft 60 extends below the engine 40 where it is connected to a drive shaft 64. Though not shown, the drive shaft 64 extends downwardly through the lower unit 20, where it drives a bevel gear and a conventional forward-neutral-reverse transmission. A control (not shown) is preferably provided for allowing an operator to remotely control the transmission from the watercraft 12. The transmission drives a propeller shaft which is journalled within the lower section 24 of the lower unit 20 in a known manner. Referring to FIG. 1, a hub 66 of the propeller 64 is coupled to the propeller shaft for providing a propulsive force to the watercraft 12 in a manner well known in this art.

Referring again to FIG. 2, the crankshaft 60 is journalled for rotation with respect to the cylinder block 42. A crankcase cover 68 engages an end of the block 42 generally opposite the heads 44, 46 (i.e. closest to the watercraft 12) defining therewith a crankcase chamber 70 within which the crankshaft 60 rotates. The crankcase cover 68 may be attached to the cylinder block 42 by bolts or similar means for attaching known to those skilled in the art.

The engine 40 includes an air intake system for providing air to each combustion chamber 56. The intake system is preferably positioned at the crankcase or watercraft end of the engine 40. Referring to FIGS. 1 and 3, air passes through a vent 72. The vent 72 includes a vent cowling 74 having one or more slots or passages therethrough. The vent cowling 74 cooperates with the upper cowling 16 to define an intake chamber 76. An upstanding inlet pipe 78 extends into the chamber 76 and defines a passage leading therethrough from the chamber 76 to the space surrounding the engine 40.

Figure 4:
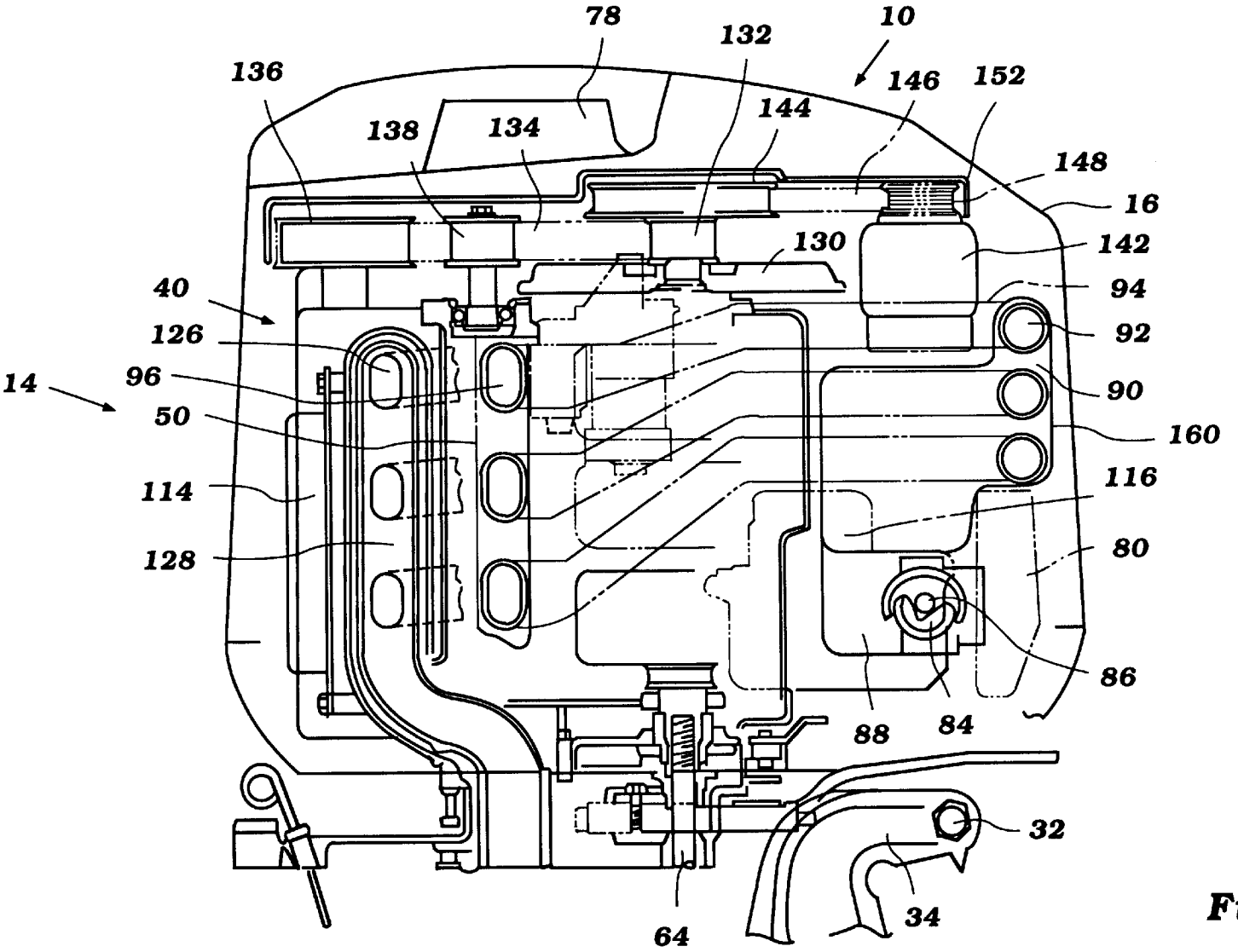
FIG. 4 is a cross-sectional view of a second side of the powerhead portion of the motor illustrated in FIG. 1.

Referring to FIGS. 2–4, air is drawn from around the engine 40 into an opening 80 (see FIG. 2) of a silencer 82. As illustrated in FIG. 4, the silencer 82 is positioned near a bottom of the powerhead 14. Air flowing through the silencer 82, which may include a filter element, passes into a generally horizontal extending throttle body 84. A throttle valve 86 is associated with the body 84 for controlling the air flow rate therethrough. The valve 86 is preferably remotely operable from a control (not shown).

Air passing through the throttle body 84 flows into a lower section 88 of a single surge tank 90. A port 92 is provided in the surge tank 90 corresponding to each cylinder 52. An intake runner, or pipe, 94 extends from each port 92 to an intake passage 96 leading through a respective cylinder head 44, 46 to a cylinder 52. Thus there are three runners 94 corresponding to each bank 48, 50. A first group of three runners 94 extends from one side of the surge tank 90 along the outside of the engine 40 and cylinder block 42 to the first cylinder head 44, and a second group of three runners 94 extends from the opposite side of the surge tank 90 along the outside of the engine 40 to the second cylinder head 46.

Referring primarily to FIG. 2, each runner 94 is connected to the surge tank 90 with a connecting part 98 such as a rubber pipe. An adjustable band, or hose clamp, 100 is preferably utilized to secure to connecting part 98 to a connecting portion 102 of the surge tank 90. Each of the six runners 94 are connected to the surge tank 90 in this manner.

Still referring primarily to FIG. 2, means are provided for controlling the flow of air through each intake passage 96 into its corresponding combustion chamber 56. Preferably, this means comprises at least one intake valve 104 corresponding to each intake passage 96. As illustrated, all of the intake valves 104 for each bank of cylinders are preferably actuated by a single intake camshaft 105. Each intake camshaft 105 is mounted for rotation with respect to its respective cylinder head 44, 46 and connected thereto with at least one bracket. Each intake camshaft 105 preferably rotates within an enclosure defined by the cylinder head 44, 46 and a camshaft cover connected thereto.

As is well known to those of skill in the art each intake valve 104 has a head which is adapted for seating against a valve seat in the passage 96, and a stem extending from the head through a valve guide to a follower. A spring is positioned between the follower and a portion of the cylinder head 44, 46 for biasing the valve 104 upwardly into a closed position.

Fuel is supplied to the incoming air with a fuel supply system. Preferably, a pump 106 draws fuel from a fuel supply (such as a fuel tank positioned in the watercraft 12) and delivers it through a filter 108 to a vapor separator 110. Fuel is supplied from the separator 110 under high pressure (such as by a high pressure pump mounted in the separator) to a fuel injector 112. As illustrated, an injector 112 is provided corresponding to each intake passage 96 and delivers fuel into the air passing therethrough.

It is noted that the individual fuel lines or pipes interconnecting the various portions of the fuel system are not illustrated in the figures, these features being well known to those of skill in the art and forming no part of the invention herein. It is also noted that, as well known to those of skill in the art, the fuel may be supplied to the engine with other than fuel injector(s), such as a carburetor, or the fuel injector(s) may be arranged to deliver fuel directly into each combustion chamber 58 or into a common manifold area.

Preferably, control means are provided for selectively opening a valve associated with each injector 112 for controlling the timing and quantity of fuel delivered therethrough into the air passing through the passage 96. This means may comprise an electronic control unit (ECU) or other electronic control 114. Preferably, the ECU 114 is mounted to the engine 44 in the valley between the banks 48, 50.

As illustrated, the filter 108, vapor separator 110 and an electronics box 116 are all mounted directly to the engine 40. A first mount 118 is preferably connected to the crankcase cover 68 with one or more bolts 120 connected to a boss portion 122 of the cover 68. This first mount 118 extends outwardly from the engine 40 for mounting of the filter 108 and separator 110, as illustrated in FIGS. 2 and 3.

A generally "T"-shaped mount 124 is preferably mounted to the crankcase cover 68 generally opposite the first mount 118. The electronics box 116 is preferably connected to this mount 124. This box 116 may contain electronics relating to an ignition system, fuel pump controls or the like.

The fuel and air mixture which is delivered to each combustion chamber 56 is preferably ignited with an ignition system. This system is not described herein and may be of a variety of types well known to those of skill in the art.

Referring to FIGS. 2–4, an exhaust system is provided for routing the products of combustion within the combustion chambers 56 to a point external to the engine 40. In particular, an exhaust passage 126 leads from each combustion chamber to a main exhaust passage 128 corresponding to each bank 48, 50. The main passage 128 corresponding to each bank 48, 50 is preferably defined by the cylinder head 44, 46 corresponding thereto. Each passage 126 leads downwardly through the valley of the engine 40 to the bottom of the engine. Thereafter, though not shown in detail, the exhaust from each bank 48, 50 passes through a passage through an exhaust guide positioned at the bottom end of the engine, and thereafter into the lower unit 20 of the motor 10 to an appropriate above or below the water discharge.

Referring still to FIG. 2, means are also provided for controlling the flow of exhaust from each combustion chamber 56 to its respective exhaust passage 126. Preferably, this means comprises at least one exhaust valve 106. Like the intake valves 104, the exhaust valves 106 of each cylinder bank are preferably all actuated by a single exhaust camshaft 129. Each exhaust camshaft 128 is journalled for rotation with respect to its respective cylinder head 44, 46 and connected thereto with at least one bracket. Each exhaust camshaft 129 is preferably enclosed within the same camshaft cover which covers the adjacent intake camshaft 105.

As with each intake valve 104, each exhaust valve 106 preferably includes a head for selective positioning against a valve seat in the passage 126. A stem extends from the head of the valve 106 through a valve guide in the cylinder head 44, 46. A follower is positioned at the opposite end of the stem for engagement by the camshaft 128. A spring is positioned between the follower and the cylinder head 44, 46 for biasing the valve 106 into its closed position.

As best illustrated in FIGS. 1 and 2, means are provided for driving the camshafts 105, 129. Preferably, each camshaft 105, 129 is driven by the crankshaft 60.

In this arrangement, the crankshaft 60 is journalled at the top end of the cylinder block 42 of the engine 40. A flywheel 130 is maintained in position on the crankshaft 60 just above the cylinder block wall.

At least one camshaft is preferably driven by a flexible transmitter, such as a belt or chain. Preferably, the camshaft drive is preferably arranged so that the crankshaft 60 drives at least one camshaft 105, 128 of each bank with a flexible transmitter such as a belt or chain. Preferably, the camshaft drive includes a camshaft drive pulley 132 connected to the crankshaft 60 above the flywheel 130 which drives a belt 134, the belt 134 in turn driving a driven pulley 136 mounted to the end of each of the exhaust camshafts 128.

Preferably, the belt 134 is routed around an idler pulley 138. As best illustrated in FIG. 2, the idler pulley 138 is positioned in the valley of the engine 40. The idler pulley 138 may comprise a pulley wheel mounted to a rotatable support shaft. In this arrangement, the belt 134 extends from the camshaft drive pulley 132 around a part of the idler pulley 136 to a first of the driven pulleys 136, across to the second driven pulley 136, and then back to the camshaft drive pulley 132.

As illustrated in FIG. 2, the engine 40 may include additional engine auxiliary features or accessories such as a starter motor 140 and an alternator 142. Preferably, the starter motor 140 is positioned for engagement with the flywheel 130 for use in starting the engine 40, as is well known to those skilled in the art.

The alternator 142 is preferably utilized to produce electricity for firing the spark plugs and similar functions. The alternator 142 is driven by the crankshaft 60 in accordance with the drive arrangement of the present invention.

In accordance with this invention, a second or accessory drive pulley 144 is connected to the crankshaft 60. Preferably, this pulley 144 is positioned above the first drive pulley 132. A flexible transmitter 146 is driven by this pulley 144 and drives an alternator pulley 148.

In this embodiment, the alternator 142 is positioned at the crankcase end of the engine 40 and connected thereto with one or more brackets 150. So that the alternator pulley 148 is positioned in the same horizontal plane as the belt 146, the top of the surge tank 90 has a recessed area to accommodate a portion of the alternator 142, as best illustrated in FIG. 4.

So arranged, the alternator drive belt 146 extends in a first direction from the crankshaft 60, while the camshaft drive belt 134 extends in generally the opposite direction therefrom.

Preferably, a cover 152 extends over the entire accessory and camshaft drive of the engine 40, as best illustrated in FIG. 4. The cover 152 protects an operator of the motor 10 from opening the cowling 16 and being exposed to the rotating belts and pulleys associated with the drive, protecting the operator. In addition, the cover 152 may cooperate with the intake 72 to guide cool incoming air into the space surrounding the drive belts for cooling the belts and associated components.

Though not shown, the engine 40 may be provided with a lubricating system for providing lubricant to the various portions of the engine. In addition, though not described or illustrated herein in detail, the engine 40 preferably includes a suitable cooling system as well known to one of skill in the art.

The engine 40 just described has an induction and component arrangement which has several particular advantages. First, as is best illustrated in FIG. 2, the induction system includes but a single, generally centrally located surge tank 90. This permits the intake pipes 94 to extend from the end of the engine 40 over a substantial length with minimal bends or bending angles, providing for smooth intake air flow.

Even though the intake pipes 94 are long and with minimal bends, the engine 40 still has a compact arrangement. First, the intake pipes 94 extend to each intake passage 96 from a front side of the surge tank 90. This permits the engine 40 to have a more compact design, since accessories are located both in between the engine 40 and the intake pipes 94. For instance, the starter motor 140 is located between the engine 40 and the intake pipes 94. On the other side of the engine 40, the fuel pump is located between the engine 40 and the intake pipes 94.

In addition, components are located underneath the intake pipes 94, which advantageously extend from a top portion of the surge tank 90. As best illustrated in FIG. 2 and FIG. 3, the vapor separator 110 and the fuel filter 108 are located underneath the intake pipes 94. On the opposite side of the engine 40, the electronics box 116 is mounted beneath the intake pipes 94 in order to minimize the overall size of the motor 10.

Figure 5:
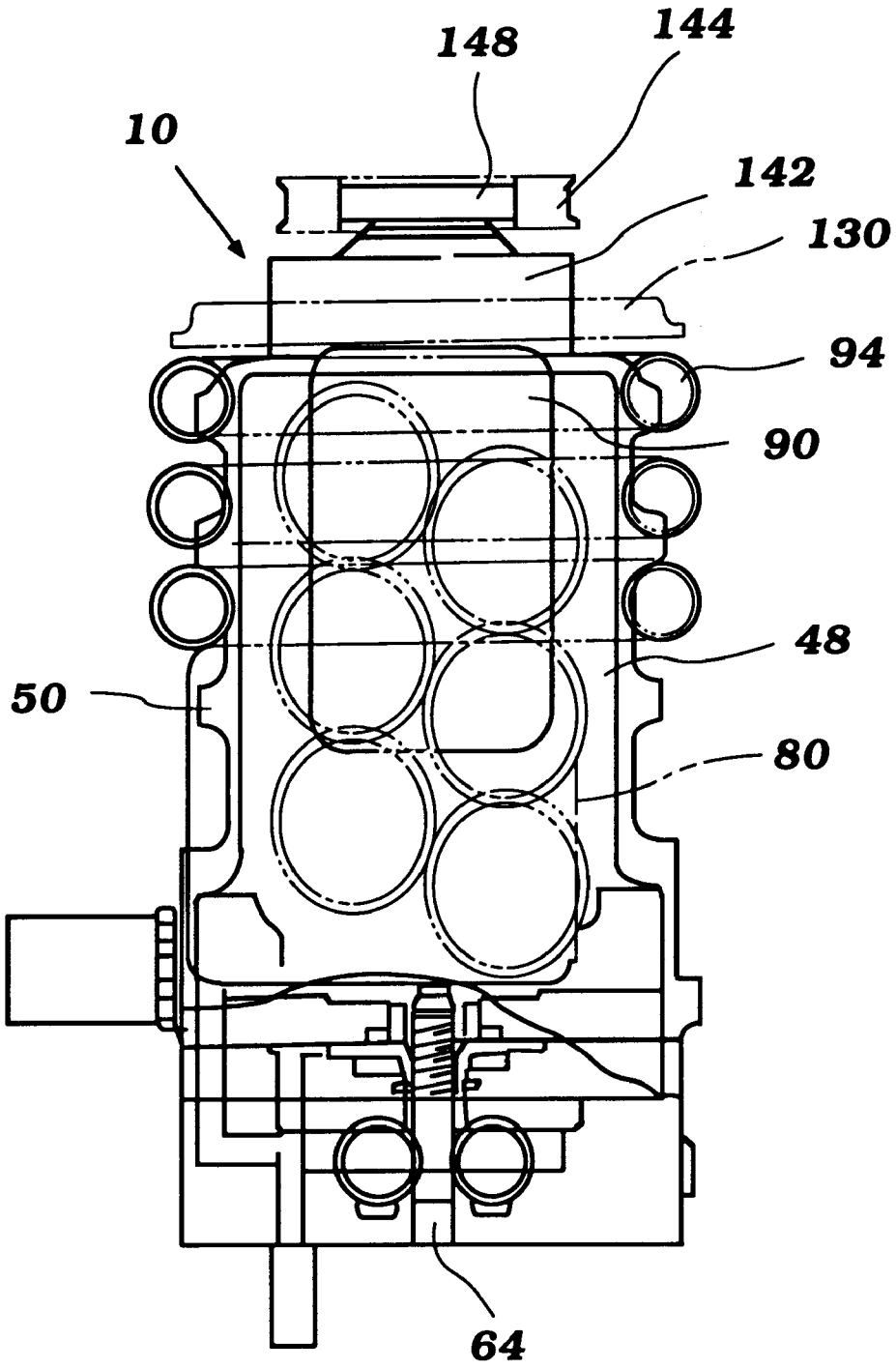
FIG. 5 is an end view, in partial cross-section, of a portion of the engine powering the motor illustrated in FIG. 1.

As best illustrated in FIGS. 3, 4 and 5 the surge tank 90 preferably has a connection part to the intake pipe 94 at a higher height than the intake passage 96 to aid in the induction process. In order to achieve this the highest connection part 160 (see FIG. 4) of the surge tank 90 extends higher than the main portion of the surge tank 90. In order to maximize the utility of the space, a recess is formed directly in front of the highest portion 160 in which the alternator 142 is mounted.

Of course, the foregoing description is that of preferred embodiments of the invention, and various changes and modifications may be made without departing from the spirit and scope of the invention, as defined by the appended claims.

What is claimed is:

1. An outboard motor for use in propelling a watercraft, the motor having a cowling in which is positioned an internal combustion engine, said internal combustion engine comprising a V shaped cylinder block cooperating with first and second cylinder heads to define first and second cylinder banks, said cylinder banks forming a valley therebetween juxtaposed to a first end surface of said cowling, each of said cylinder banks including at least one combustion chamber, a crankcase located at an end of said block opposite said heads forming a crankcase chamber in which a crankshaft is journalled for rotation about a vertical axis, said crankcase being juxtaposed to a second end surface of said cowling, an exhaust system for routing the products of combustion from said at least one combustion chamber of each of said cylinder banks, an intake system for providing air to said at least one combustion chamber of each of said cylinder banks, said intake system including a single surge tank positioned between said cowling second end surface and said crankcase of said engine, at least one first intake pipe extending directly from said surge tank in a first direction along said cylinder block to said first cylinder head and at least one second intake pipe extending directly from said surge tank along said cylinder block to said second cylinder head.

2. The outboard motor of claim 1 wherein a silencer is located, at least in part, under said surge tank for delivering air to said surge tank, and further including a throttle body member located in the flow path between said silencer and said surge tank.

3. The outboard motor of claim 1 wherein said at least one first intake pipe is located on a first side of said V shaped cylinder block outside of said valley and a first component is mounted beneath said at least one first intake pipe and said at least one second intake pipe is located on a second side of said V shaped cylinder block outside of said valley and a second component is mounted beneath said at least one second intake pipe.

4. The outboard motor of claim 3 wherein the first component is an ignition control and the second component is a vapor separator.

5. The outboard motor of claim 3 further including a third component being located between said at least one first intake pipe and said V shaped cylinder block and a fourth component is located between said at least one second intake pipe and said V shaped cylinder block.

6. The outboard motor of claim 5 wherein said third component is a starter motor and said fourth component is a fuel pump.

7. The outboard motor of claim 6 wherein said first component and said third component are located on one side of said V shaped cylinder block and said second component and said fourth component are located on a second side of said V shaped cylinder block.

8. The outboard motor of claim 1 wherein an alternator is mounted above said surge tank.

9. The outboard motor of claim 1 wherein the surge tank is located between a surface of the crankcase facing away from the cylinder block and the cowling.

10. The outboard motor of claim 9 wherein the surge tank does not extend transversely beyond the sides of the crankcase.

* * * * *